US006032952A

United States Patent [19]

Walsh

[11] Patent Number: 6,032,952

[45] Date of Patent: Mar. 7, 2000

[54] DOCUMENT HANDLING SYSTEM HAVING A SELF-LEVITATING PRESSURE LOADING DEVICE

[75] Inventor: James D. Walsh, Rochester, N.Y.

[73] Assignee: Xerox Corporation, Stamford, Conn.

[21] Appl. No.: 08/841,317

[22] Filed: Apr. 30, 1997

[51] Int. Cl.[7] ..... B65H 5/02; B65H 9/16

[52] U.S. Cl. ..... 271/275; 271/276; 271/248

[58] Field of Search ..... 271/276, 309, 271/275, 220, 253, 240, 248, 198, 194, 195, 493

[56] References Cited

U.S. PATENT DOCUMENTS

| | | | |
|---|---|---|---|
| 3,593,990 | 7/1971 | Plumat et al. | 271/276 |
| 3,937,454 | 2/1976 | Colwill | 271/6 |
| 3,988,019 | 10/1976 | Achelpohl | 271/180 |
| 4,190,185 | 2/1980 | Thate | 226/172 |
| 4,669,721 | 6/1987 | Westover | 271/272 |
| 4,831,419 | 5/1989 | Iaia, Jr. et al. | 355/76 |
| 5,120,046 | 6/1992 | Mandel et al. | 271/236 |
| 5,382,015 | 1/1995 | Buddendeck et al. | 271/275 |
| 5,411,251 | 5/1995 | Schmid et al. | 271/195 |
| 5,669,603 | 9/1997 | Detmers et al. | 271/183 |

OTHER PUBLICATIONS

Xerox Disclosure Journal, vol. 7, No. 6, Nov./Dec. 1982 entitled "Document Registeration with "Ski" Assisted Scuffer Wheel" Author: Taylor et al.

*Primary Examiner*—Donald P. Walsh
*Assistant Examiner*—Daniel K Schlak

[57] ABSTRACT

A document handling system adapted for delivery of input documents to an imaging station of an imaging input terminal, wherein a friction transport belt transports the input documents across an imaging platen of the imaging station. The belt is urged into planar orientation with the platen by a self-levitating pressure loading element in the form of a ski-like member that bears upon the belt for encouraging flat or horizontal orientation of input documents on an imaging platen. The ski like member is provided with a configuration for capturing inherent airflow generated by the transport motion of the belt so as reduce the load pressure produced by the ski when the transport belt is in motion, thereby reducing frictional forces to substantially reduce drag and wear in the document handling system.

8 Claims, 4 Drawing Sheets

DOCUMENT HANDLING SYSTEM HAVING A SELF-LEVITATING PRESSURE LOADING DEVICE

This invention relates to a document handling system of the type typically utilized with automatic electrostatographic printing machines, and, more particularly, concerns an improved document transport and positioning device for use in advancing input copy documents and other sheet-like materials into imaging position on a platen or other flat surface.

Generally, the process of electrostatographic copying is initiated at an image input terminal, whereat an original input document is exposed for generating a light image thereof. This light image is transmitted onto a substantially uniformly charged photoreceptive member for selectively discharging the photoconductive surface thereof in image configuration corresponding to the image and the non-image areas in the original document so as to create an electrostatic latent image of the original document on the photoreceptive member. The latent image is subsequently developed into a visible image by depositing a charged developing material onto the photoconductive surface so that the developing material is attracted to the image areas. Thereafter, the developing material is transferred in image configuration from the photoreceptive member to an output copy substrate to which the image may be permanently affixed, thereby producing a so-called "hard copy" reproduction of the original document. In a final process step, the photoconductive surface of the photoreceptive member is cleaned to remove any residual developing material and/or electrostatic charges therefrom in preparation for successive imaging cycles.

The electrostatographic copying process described above is well known and is commonly used for light lens copying of an original document. Analogous processes also exist in other electrostatographic copying and printing applications such as, for example, digital electrostatographic printing, where the electrostatic latent image is generated in response to electronically generated or stored images. Another example of an analogous process can be found in ionographic printing, wherein charge is selectively deposited in image configuration on a dielectric charge retentive surface for producing electrostatic latent images thereon.

In a typical document handling system of the type often used for imaging an original input image in the an electrostatographic copying or printing machine, the original input document, which typically takes the form of a sheet-like substrate, is transported from a document input station to an imaging station via a series of belts and/or rollers. The document transport system mechanically advances the input document along a predetermined path to deliver the document onto the imaging station surface, typically in the from of a glass platen. The input document must be delivered to a predetermined imaging position in proper registration in the horizontal plane in order to prevent image defects caused by image misregistration such as skewed image orientation and or image portions in non-imageable areas. Moreover, in order to yield minimal optical distortion and to produce optimum copy quality, it is necessary to position the input document on the platen in a manner such that the input document is substantially flat and generally flush against the platen; otherwise, any unevenness or incongruities, caused, for example, by the presence of wrinkles or ripples in the material making up the input document, result in poor image quality.

The problem of optical distortion of images due to unevenness or irregularities in the smoothness of the input document is exacerbated in more advanced optical imaging systems and electronic scanning devices which tend to utilize optical paths having relatively short conjugate lengths, as is desirable for reducing size and increasing efficiency. However, shorter conjugate length imaging systems cannot easily compensate for separation between the sheet-like material of the input document and the glass platen, resulting in an optical systems which is less forgiving with respect to optical distortion as compared to longer conjugate length systems. This problem is acutely prevalent as the distance from the center of the imaging area of the platen increases. Thus, even a slight ripple or rise in the input document in the margin areas of the image input system may result in an unacceptably distorted image on the surface of the photoreceptive member, and, in turn, on the output copy sheet.

As previously noted, proper registration of the document in the horizontal plane is also critical, as failure to maintain the registration of the input document as it moves with the belt, generally results in an unacceptable output image. Typical image defects caused by image misregistration include: portions in non-imageable areas; skewed orientation; and like problems.

As set forth hereinabove, it is particularly important to maintaining positional control of the input document in both the horizontal and vertical planes in order to provide effective input imaging. This requirement is distinctively problematic in high speed copying applications wherein a series of input documents is sequentially transported into and out of an imaging position at a rapid rate. This document transport process is typically carried out through the use of friction belts and the like.

The use of friction belts for transporting input documents across the imaging platen presents several competing constraints. In order to provide effective document transport, the belt and input document must have a high degree of adherence relative to the adherence between the input document material and the platen, as well as between the belt and the platen. By contrast, wear and friction on the materials of the belt, the input documents, and the platen should be minimized. It is also desirable to reduce the load on the motors which drive the belts so as to reduce maintenance costs associated therewith, as well as to provide the opportunity to use less powerful drive motors.

Complicating matters, it is desirable to provide a pressure loading device capable of clamping an input document from a transport position to an imaging position flattened against the platen. This clamping function is typically accomplished by means of a mechanical pressure inducing system or pressure loading device for generating forces in a vertical plane to press the input document against the imaging platen.

It is therefore, desirable to provide a document handling system with a device for urging the transport belt in the direction of the imaging platen when an input document is in position to be imaged. Moreover, it is desirable to provide such a pressure loading clamping system having low drag on moving components and capable of yielding low wear on the imaging platen and materials associated therewith. Various techniques have heretofore been used to provide a pressure bearing load to a friction belt in a document handler, as illustrated by the following disclosures, which may be relevant to certain aspects of the present invention:

U.S. Pat. No. 3,937,454

Patentee: Colwill

Issued: Feb. 10, 1976

U.S. Pat. No. 3,988,019

Patentee: Achelpohl

Issued: Oct. 26, 1976

U.S. Pat. No. 4,190,185

Patentee: Thate

Issued: Feb. 26, 1980

Publication: Xerox Disclosure Journal

Author: Taylor, et al.

Issue: Vol. 7, No. 6, November./December. 1982

U.S. Pat. No. 4,669,721

Patentee: Westover

Issued: Jun. 2, 1987

U.S. Pat. No. 4,831,419

Patentee: Iaia, Jr. et al.

Issued: May 16, 1989

The relevant portions of the foregoing patents and publications may be briefly summarized as follows:

U.S. Pat. No. 3,937,454 discloses document recirculator for feeding documents over a platen. The belt is maintained in close proximity to the platen for moving documents by a fixed plate over the belt and an inflatable bladder positioned between the plate and the belt.

U.S. Pat. No. 3,988,019 discloses an apparatus for depositing flat flexible articles on one double belt conveyor to another double belt conveyor by two "ski like" members. The members cooperate to push the article down and from the first double belt conveyor to the second belt conveyor.

U.S. Pat. No. 4,190,185 discloses a system including first and second conveyor belts for transporting sheet material, wherein the central portion of the sheet material is intended to be unsupported and not in contact with the belt. Engagement elements are provided for contacting the edges of the sheet to place the sheet in tension for urging the sheet into a planar flattened condition.

U.S. Pat. No. 4,669,721 discloses a sheet transporting apparatus which has a belt and a flexible elongated guide between which sheets pass. The flexible guide bears upon the sheet to maintain the sheet proximate to the belt for moving the sheet between the belt and guides which may be a singular piece or several parallel members.

Xerox Disclosure Journal, Volume 7, No. 6, discloses a "ski-like member" which is mounted to a scuffer wheel for effecting registration of a document. The scuffer wheel is mounted to the ski-member in manner so that buckling of the document reduces the force applied by the scuffer wheel to the document.

U.S. Pat. No. 4,831,419 disclose a document handler vacuum belt platen transport clamping system for presenting documents to the platen of a copier, wherein the document transporting belts are movable under a substantially planar vacuum plenum which overlies the platen.

It will be understood that all of the foregoing patents and publications, as well as all additional references cited in this specification, and their references, are incorporated by reference herein where appropriate for appropriate teachings of additional or alternative details, features and/or technical background.

It can be seen from the prior art that mechanical pressure inducing systems most often used for clamping input documents against an imaging platen typically generate a load which bears upon the friction transport belt or belts of the document transport system. Such pressure inducing systems may include elongated rollers or slide plates known as "skis" situated within a belt transport loop, placing the load pressure thereagainst. Unfortunately, these "skis" or rollers often cause several undesirable effects. For example, individual rollers tend to be separated by a distance such that wavy, out of focus lines occur frequently on copies produced from the image recorded at the image input terminal. These pressure members also tend to bear relatively heavily on the portion of the platen over which they are positioned causing wear of the platen. Such wear is unacceptable since platens are often optically coated to achieve imaging performance or coated with a transparent film to reduce paper drag. In addition, undue wear is wasteful, even in the case of non-coated platens, because wear reduces the useful life of the platen and also decreases the quality of the images produced over time. Further, the area of the belt opposite the platen and at the extreme ends of the pressure members often build up dirt or other contaminants, resulting in darkening of image areas in output copies produced thereby.

Document handling systems must, therefore, move the sheet-like material of the input document without slipping and/or sticking of the sheet-like material relative to the belt. In addition, it is preferred to have a system which produces minimal belt and motor wear. It is also desired to increase the part life of the belt and motor and to reduce costs generally. The problems of wavy-line copies and out-of-focus copies of prior systems have become more acute as shorter conjugate optics are used to reduce the size and increase the effectiveness of input imaging terminals in copiers and scanners. These faulty copies result generally from a buckling of the document away from the platen or the document being held on the belt away from the platen. Thus, maintaining a document to be imaged in a flat attitude relative to the platen and proximate to the platen are necessary to avoid optical distortion and to maintain the document in focus.

In accordance with one aspect of the invention, a document handling system adapted to deliver successive input documents to an imaging station of an input image terminal is provided, comprising: a transport belt being driven along a predetermined transport path for frictionally advancing individual input documents and positioning individual input documents at the imaging station, wherein movement of the transport belt in the direction of the transport path generates an inherent airflow; a pressure loading apparatus situated proximate to the transport belt for urging the belt and input documents into a substantially flat configuration at the imaging station; said pressure loading apparatus including a predetermined configuration for enabling the apparatus to be self-levitated by the inherent airflow generated by transport of the transport belt in the direction of the transport path.

In accordance with another aspect of the present invention, an electrostatographic printing apparatus for printing a plurality of print jobs is provided, comprising: a transport belt being driven along a predetermined transport path for frictionally advancing individual input documents and positioning individual input documents at the imaging station, wherein movement of the transport belt in the direction of the transport path generates an inherent airflow; a pressure loading apparatus situated proximate to the transport belt for urging the belt and input documents into a substantially flat configuration at the imaging station; said pressure loading apparatus including a predetermined configuration for enabling the apparatus to be self-levitated by the inherent airflow generated by transport of the transport belt in the direction of the transport path.

For a general understanding of the present invention, as well as other aspects thereof, reference is made to the following description and associated drawings, in which.

While the present invention will be described with a reference to a preferred embodiment thereof, it will be understood that the invention is not to be limited to the preferred embodiment. On the contrary, it is intended that the present invention cover all alternatives, modifications, and equivalents as may be included within the spirit and scope of the invention as defined by the appended claims.

Figure 6:
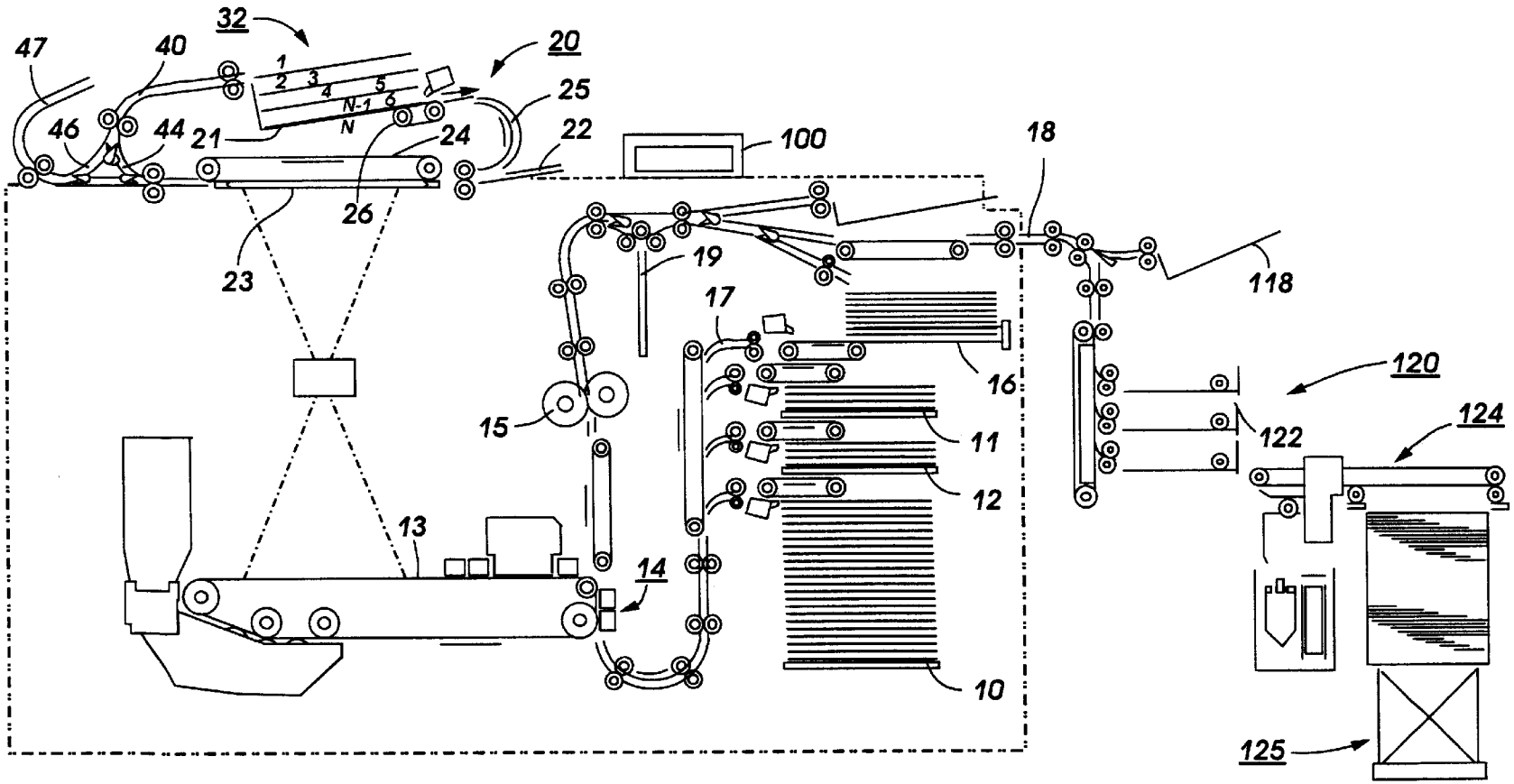
FIG. 6 is a schematic side view of an electrostatographic printing machine illustrating the principal mechanical components thereof.
Figure 7:
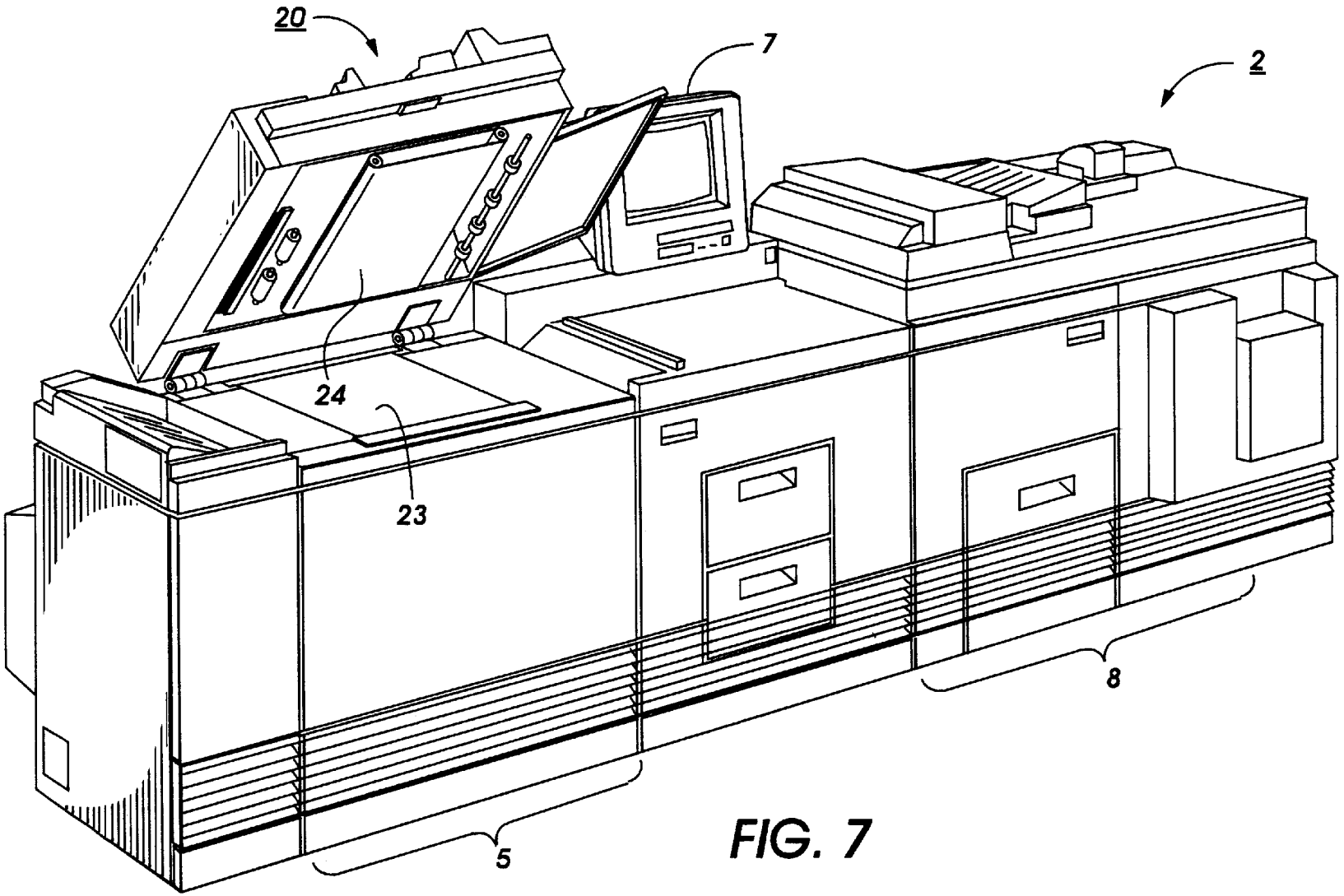
FIG. 7 is a perspective view of an exemplary electrostatographic printing machine incorporating a recirculating document handling system including the self-levitating pressure loading device of the present invention.

Inasmuch as the art of electrostatographic reproduction and printing is well known, the various process steps and processing subsystems employed in an exemplary reproduction machine will initially be described briefly with reference to FIGS. 6 and 7. It will become apparent from the following discussion that the document handling system of the present invention is equally well-suited for use in a wide variety of electrophotographic or other electronic printing systems as well as any other sheet material transport apparatus which may benefit from the advantages derived from the present invention. Other aspects and features of the present invention will become apparent as the description proceeds.

Referring initially to FIG. 7, there is shown an exemplary electrostatographic printing machine, generally identified by reference numeral 2, the principal operation of which is further described hereinbelow, as well as in various patents cited above and otherwise. For purposes of explanation, the printing system 2 is divided into an image input terminal (IIT) 5, a xerographic print engine 6, an electronic controller 7, and a document finishing section 8. This printing machine may be represented in a practical embodiment, by any of the well known copier/duplicator products manufactured by Xerox Corporation, such as the model "1075" or "5090", among others. It will be understood that, while a specific printing system is illustrated and will be described in more detail, the present invention may be incorporated into various other types of printing systems, as for example, ink jet, ionographic, laser-based exposure systems, etc.

A printing machine of the type shown in FIG. 7 is preferably adapted to provide, in a known manner, duplex or simplex collated copy sets from either duplex or simplex original input documents circulated by a document handler, generally identified by reference numeral 20. As such, and of particular interest with respect to the present invention, the image input terminal 5 incorporates an exemplary automatic recirculating document handler (RDH), of a type generally known in the art, for transporting original input documents into position on an imaging platen 23. As is conventionally practiced, and as illustrated in FIG. 7, the entire document handler unit 20 may be pivotally mounted on the machine frame so that the recirculating document handler can be pivoted away from the platen 23 by a machine operator for alternative manual document imaging placement and copying and for general access to the imaging platen 23. In this manner, the exemplary printing system 2 is designed to receive input documents which may be manually positioned on the platen glass 23, or automatically transported thereto via a transport belt 24 situated within the document handler 20, generally in contact with the surface of the platen 23 with the document handler 20 pivoted into the position on the platen 23.

The exemplary printing system will now be described in further detail with reference to FIGS. 6, wherein FIG. 6 illustrates the printing system shown in FIG. 7 in schematic form. As previously described, the RDH 20 operates to automatically feed or transport individual input document sheets onto and over the platen 23 by means of a transport system including transport belt 24. Belt 24 may be incrementally driven by a servo motor or various other drive systems known in the art. The drive system is typically controlled by a microprocessor controller which may incorporated into electronic control section 7 for sequentially positioning a series of input documents at a desired registration location on the imaging platen 23.

The RDH 20 is a conventional dual input document handler including both automatic and semiautomatic document handling (SADH) capabilities. As such, documents may be fed to the imaging station 23, transported by the platen transport belt 24, from either the SADH input 22 at one side of the RDH 20, or from the regular RDH input, namely the loading or stacking tray 21, on top of the RDH unit. While document feeding input 22 is referred to herein as the SADH input 22, it will be understood that this input is not limited to semi-automatic or "stream feeding" document input feeding and may be usable for special "job interrupt" insert jobs.

Automatic RDH document input proceeds by advancing an input document from the bottom of the stack in tray 21 through an arcuate, inverting RDH input path 25 to the upstream end of the platen transport belt 24. Input path 25 preferably includes a corrugated feeder-separator belt and air knife system 26, document position sensors (not shown), and a first set of turn baffles and feed rollers for inverting each input document prior to imaging. Document inverting or non-inverting by the RDH 20 is further described, for example, U.S. Pat. Nos. 4,794,429 or 4,731,637, among various other patents and publications.

After the input documents are imaged on the platen imaging station 23, or may be fed across the platen without copying. Each document may be further transported by the platen transport system 24 in the direction of downstream or off-platen rollers where they are fed past a gate or a series of gates and sensors for guiding the sheets directly to a document output path and then to a catch tray, or, more commonly, into an RDH return path 40 for leading the documents back to tray 21 so that the document set can be continually recirculated. This RDH return path 40 includes reversible rollers to provide a choice of two different return paths to the RDH tray 21: a simplex return path 44 with one inversion; or a reversible duplex return path 46 without an inversion, whereby the reversible rollers are rotated so as to reverse feed the previous trail edge of the sheet back into the duplex return path 46 from an inverter chute 47. This duplex return path 46 provides for the desired inversion of duplex documents in one circulation as they are returned to the tray 21 for copying opposite sides of the input documents in a subsequent circulation or circulations. Typically, the RDH inverter and inversion path 46, 47 are used only for documents loaded in the RDH input tray 21, and only for duplex documents. In normal operation, a duplex document has only one inversion per circulation, occurring in the RDH input path 24. By contrast, the simplex circulation path requires two inversions per circulation, one in each of the paths 25 and 44, whereby two inversions per circulation is equivalent to no inversion such that simplex documents are returned to tray 21 in their original (face up) orientation via simplex path 44.

The entire stack of originals in the RDH tray 21 can be recirculated and copied as many times as required to produce a selected plurality of collated copy sets. Thus, the document set or stack may be RDH recirculated any number of times to produce any desired number of collated duplex print sets, that is, collated sets of duplex copy sheets, in accordance with various instruction sets known as print jobs which can be programmed into the controller 100.

Since the copy or print operation and apparatus of the present invention is well known and taught in the prior art, the system will not be described in detail herein. Briefly, blank, or even pre-printed, copy sheets are conventionally fed from paper trays 11 or 12, or a high capacity feeder tray 10, for having a developed image transferred thereto from photoreceptor 13 at transfer station 14. Each copy sheets is thereafter transported to a fusing station 15, for affixing the transferred image to the copy sheet, with the copy sheets being output via output path 18 if they are to be simplex copies. Alternatively, the fused output copy sheets can be temporarily stacked in a duplex buffer tray 16 if they are to be duplexed, from which they are subsequently inverted and returned, via path 17, for having a second side image transferred thereto in the same manner as the first side. This duplex tray 16 has a finite predetermined sheet capacity, depending on the particular copier design. The completed duplex copy is preferably transported to an integral finishing and stacking module via output path 18. An optionally operated copy path sheet inverter 19 is also provided.

Output path 18 may be directly connected in a conventional manner to a generally known bin sorter 120 as is generally disclosed in U.S. Pat. No. 3,467,371, for example. Bin sorter 120 includes a vertical bin array 122 which is conventionally gated to deflect a selected sheet into a selected bin as the sheet is transported past the bin entrance. An optional gated overflow top stacking or purge tray may also be provided for each bin set. The vertical bin array 122 may also be bypassed by actuation of a gate therein to direct sheets serially onward. The resulting sets of prints are then discharged to finisher 124 which may include a stitcher for stapling print sets together and/or a thermal binder for adhesively binding the print sets into books. A stacker 125 is also provided for receiving and delivering final print sets to an operator or to an external third party device.

All copier and document handler and sorter operations are preferably controlled by a generally conventional programmable controller 100 which is typically programmed with certain novel functions and graphic user interface features for the operation of the electrostatographic printing system. The controller 100 preferably comprises a known programmable microprocessor system, as exemplified by U.S. Pat. No. 4,475,156, as well as extensive prior art, for controlling the operation of the machine and processes described herein, including the actuation of the document and copy sheet feeders, as well as inverters, gates, etc.

It shall be understood that multiple print jobs, once programmed, are scanned and printed and finished under the overall control of the machine controller 100. The printer controller monitors and controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device. The printer controller initiates a sequencing schedule which is highly efficient in monitoring the status of a series of successive print jobs which are to be printed and finished in a consecutive fashion.

Figure 1:
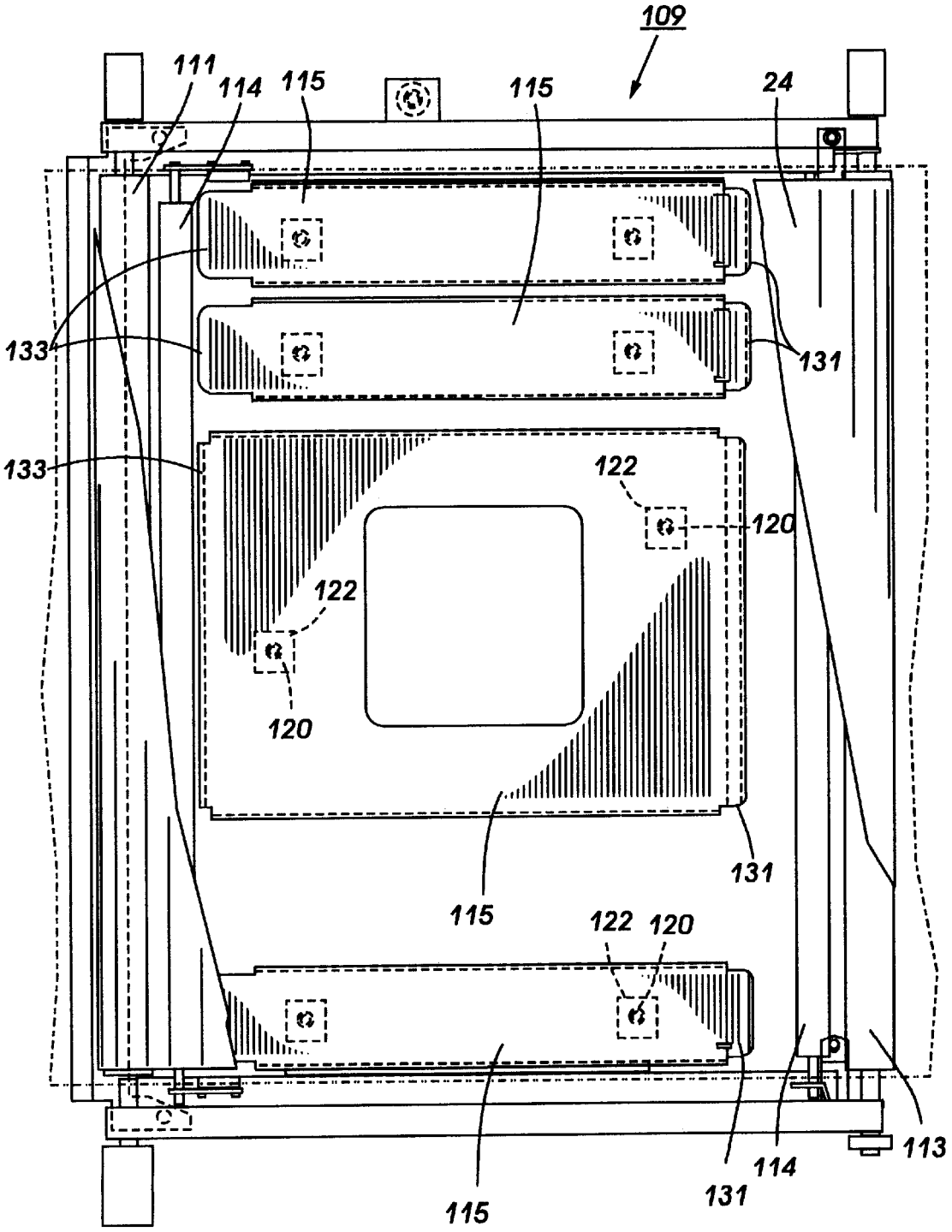
FIG. 1 shows a top view of an exemplary recirculating document handling platen transport system of the type typically utilized and incorporated into an electrostatographic reproducing machine.

Moving now to a more detailed description of the document handling system, FIG. 1 shows a transport frame 109 which supports the transport belt 24, illustrated in a broken away view to provide a view of the components concealed thereby. The belt 24 is entrained about a drive roller 111 and a tension roller 113 and elongated rollers 114 which are rotatably supported by frame 109 and disposed adjacent document entry and exit points defining a curvilinear path of transport for the belt 24.

A plurality of elongated slide members or skis 115 extend substantially between the elongated rollers 114 along a linear segment of the curvilinear path of travel of the belt 24, adjacent the imaging platen 23 (not visible in FIG. 1). As previously indicated, the skis 115 operate to generate load pressure against the belt 24, and in turn, against the input copy document with the document handler in an active position juxtaposed with the imaging platen 23, for urging the input document into a flat configuration thereon. As such, the skis 115 may be loaded into an operative position merely by gravity. Alternative embodiments have been described in the prior art wherein a spring element or other urging member may be included to provide either a positive or negative load of selected magnitude to the ski 115.

Figure 2:
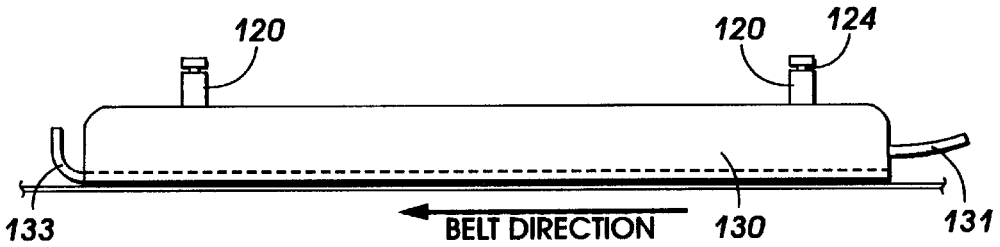
FIG. 2 PRIOR ART
FIG. 2 is a side elevational view of a prior art belt pressure loading device of the type typically used in the document handling system of FIG. 1.

In an exemplary embodiment, as shown in the prior art example of FIG. 2, each ski 115 has upwardly extending mounting fingers 120 extending to a mounting bracket 122 located on frame 109, wherein the fingers 120 are engageable with frame 109 via a grooved portion formed in the finger 120. The mounting arrangement preferably permits free movement of the fingers 120 along a longitudinal axis thereof, thereby permitting the skis 115 to move up and down depending on the normal force transmitted from the belt. The mounting arrangement also preferably permits slight lateral or rotational movement of fingers 120 for permitting some movement or freedom in the plane parallel to the platen 23.

The skis 115 are typically provided with upwardly extending portions 131 situated adjacent the input document entry portion of the platen 23. In addition, each ski 115 can be curled slightly along the tips 133 adjacent the document exit to further reduce wear on the platen 23 at the exit tips 133 of the skis 115. It will be noted that various document handlers are present in the marketplace, particularly those having dual directional document feeding capabilities, such that skis having raised or curled tips at both end may be appropriate.

The ski members 115 are relatively light construction, and may be fabricated from a low weight carbon steel material of between 0.06 and 1.5 mm and preferably 0.8 mm in thickness. It will be understood that various coatings such as teflon or electrolytic coatings, or a preferred nonelectrolytic nickel steel coating can be used to reduce friction between the belt and skis. The skis 115 disclosed and taught herein tend to provide a relatively smooth and flat belt surface on which the document to be imaged is maintained so as to urge the input document to be substantially parallel to the platen and in close proximity therewith for eliminating out-of-focus portions in the image produced thereby.

Figure 3:
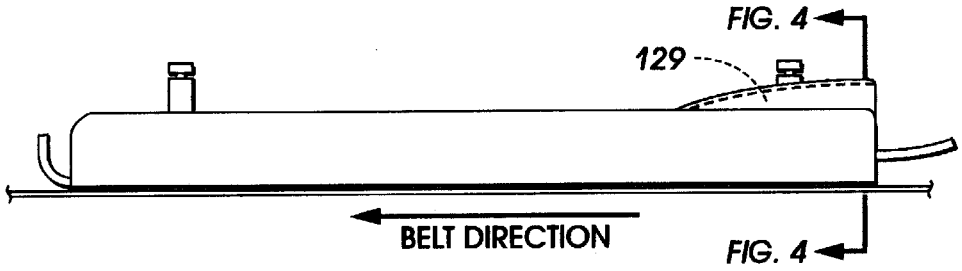
FIG. 3 is a side elevational view of an exemplary self-levitating pressure loading device in accordance with the present invention.
Figure 4:
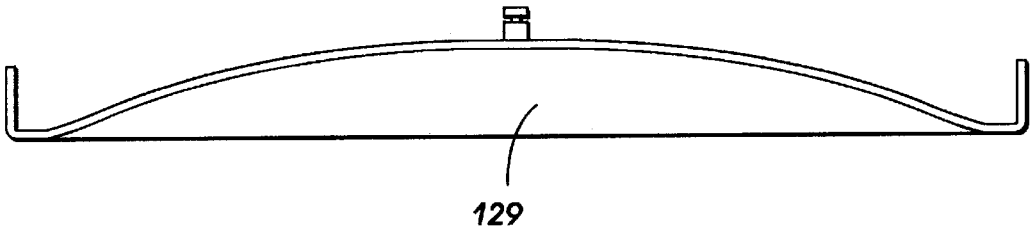
FIG. 4 is a front elevational view of the exemplary self-levitating pressure loading device shown in FIG. 3.
Figure 5:
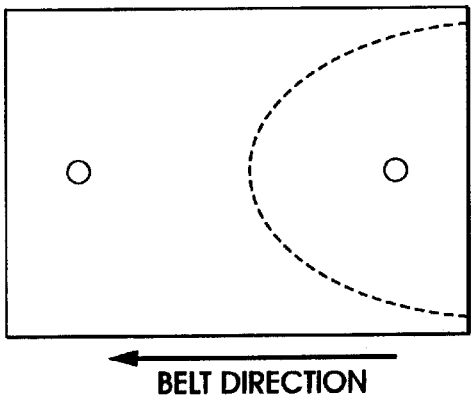
FIG. 5 is a top view of the exemplary self-levitating pressure loading device shown in FIGS. 3 and 4.

In spite of curled tips, lightweight construction, and specialized coatings, which may be practiced individually or in combination, the skis as thusfar tend induce unacceptable levels of friction which reduces the useful life of the transport belt as well as drive components of the document handler and causes wear of the imaging platen which decreases the quality of the images produced over time. The improved ski of the present invention is directed toward an improved ski which is capable of being levitated by the inherent airflow generated by transport motion of the transport belt 24. As such, in accordance with the present invention, a typical ski as known in the prior art is provided with a particularized configuration for enabling self-levitation thereof. FIGS. 3–5 illustrate an exemplary embodiment of the present invention, wherein the self-levitating feature thereof is provided a raised air inlet portion 129 situated along the lead edge of the ski 115, in an area corresponding to the document entrance area of the document handling system. The air inlet 129 is provided for capturing inherent airflow adjacent the surface of transport belt 24, generated by the transport motion thereof, wherein the captured airflow causes the ski to be slightly elevated, or self-levitated, when the transport belt is in motion. This self-levitation reduces the load pressure produced by the ski when the belt is in motion, thereby reducing frictional forces exerted thereagainst.

In operation, the pressure loading ski operates in a manner similar to the operation of a typical prior art ski with the exception that the ski is slightly elevated during movement of the transport belt 24. Thus, with the belt in a standing position, such as when the input document is in imaging position on the imaging platen, the ski rests against the belt 24, generating a load pressure thereagainst which is transferred to the input document for causing the document to lay as flat as possible on the imaging platen. Conversely, with the transport belt 24 in motion, air in the immediate vicinity of the belt, commonly known as the boundary layer, is caused to move, generating airflow in the direction of movement of the belt which is captured by air inlet 129. As the air is captured within the air inlet 129, the air pressure underneath the ski is increased to a point at which this air pressure exceeds the air pressure or other forces acting against the top surface of the ski such that the ski is raised in the region of the air inlet by this air pressure differential. As the air inlet portion 129 of the ski is raised, a greater amount of air is permitted to flow underneath the ski in total, thereby levitating the entire ski. The ski is elevated to a height whereby the air volume captured by the inlet is permitted to escape such that the height of levitation becomes a function of the velocity at which the belt is transported.

It will be understood that the air inlet 129 of ski 115 may be defined by various sizes, shapes and/or configurations sufficient for capturing airflow generated adjacent the surface of transport belt by the movement thereof. In fact, it can be shown that self-levitation can be induced by merely providing a lip having an acute angle of approximately 45 degrees along the lead edge of the ski. In addition, the self-levitating system may be utilized in a document handling apparatus which employs a single ski or a plurality of skis While the use of the self levitating ski of the present invention will not completely eliminate the frictional forces acting against the belt and imaging platen, these frictional forces can be minimized and/or equalized via the instant self-levitating ski. In fact, the self levitating ski tends to divide the frictional forces into three components: a first component associated with the forces created between the ski and the airflow beneath the ski; and a second component associated with the interface between the airflow and the belt; and a third component associated with belt surface to platen surface contact which tends to be reduced due to the first two component forces. As a result, although the normal force exerted against the belt remains approximately equal to the force exerted by the weight of the ski, the normal forces are more evenly distributed over the surface of the belt due to the cushion of air generated therebetween. The relatively even distribution of forces also encourages more efficient and effective movement of the sheet-like material of the input with reduced buckling, slippage, or similar problems.

In review, a self-levitating pressure loading device has been disclosed for encouraging flat or horizontal orientation of input documents on an imaging platen. The self-levitating feature of the present invention reduces the load pressure produced by the ski when the belt is in motion, thereby reducing frictional forces exerted thereagainst to reduce excessive wear and erosion forces. The reduced frictional forces substantially reduce the drag and wear associated with prior art document handling systems, yielding a lower cost of operation due to reduced motor torque and operating currents, as well as, increased lifetime of components. The present invention also tends to yield increased paper handling reliability. Thus, an improved document transport for use with document handlers of image input terminals has been disclosed.

I claim:

1. A document handling system for delivering successive input documents to an imaging station of an input image terminal, comprising:

a transport belt driven along a predetermined transport path for frictionally advancing individual input documents and sequentially positioning individual input documents at the imaging station for imaging thereof, wherein transport motion of the transport belt in the direction of the transport path generates an inherent airflow; and a pressure loading apparatus situated proximate to the transport belt for urging said transport belt and input documents into a substantially flat configuration at the imaging station;

said pressure loading apparatus including a predetermined configuration for enabling said apparatus to be levitated by the inherent airflow generated by transport motion of the transport belt.

2. The document handling system of claim 1, wherein said pressure loading member includes at least one generally planar elongated ski member contacting said belt over an extended surface area thereof.

3. The document handling system of claim 2, wherein the generally planar elongated ski member includes an air inlet portion situated along a lead edge of said pressure loading member in a region corresponding to an input document entrance in the document handling system.

4. The document handling system of claim 3, wherein the air inlet portion is adapted to capture the inherent airflow generated by the transport motion of said transport belt for levitating the ski member.

5. An electrostatographic printing apparatus for printing a plurality of print jobs, including a document handling system for delivering successive input documents to an imaging station of an input image terminal, comprising:

a transport belt driven along a predetermined transport path for frictionally advancing individual input documents and sequentially positioning individual input documents at the imaging station for imaging thereof, wherein transport motion of the transport belt in the direction of the transport path generates an inherent airflow; and a pressure loading apparatus situated proximate to the transport belt for urging said transport belt and input documents into a substantially flat configuration at the imaging station;

said pressure loading apparatus including a predetermined configuration for enabling said apparatus to be levitated by the inherent airflow generated by transport motion of the transport belt.

6. The electrostatographic printing apparatus of claim 5, wherein said pressure loading member includes at least one generally planar elongated ski member contacting said belt over an extended surface area thereof.

7. The electrostatographic printing apparatus of claim 6, wherein the generally planar elongated ski member includes an air inlet portion situated along a lead edge of said pressure loading member in a region corresponding to an input document entrance in the document handling system.

8. The electrostatographic printing of claim 7, wherein the air inlet portion is adapted to capture the inherent airflow generated by the transport motion of said transport belt for levitating the ski member.

* * * * *